US007461946B2

(12) United States Patent
Dalton et al.

(10) Patent No.: US 7,461,946 B2
(45) Date of Patent: Dec. 9, 2008

(54) LIGHTING DEVICE

(75) Inventors: David R. Dalton, Turramurra (AU); Timothy Rugendyke, Woy Woy (AU); John R. Brown, Mosman (AU); Scott Allen, Frederiksberg (DE); Robert Englert, Syracuse, NY (US); Scott Osiecki, Skaneateles, NY (US); Andrew Schweitzer, Camillus, NY (US)

(73) Assignee: Eveready Battery Company, Inc., St. Louis, MO (US)

( * ) Notice: Subject to any disclaimer, the term of this patent is extended or adjusted under 35 U.S.C. 154(b) by 25 days.

(21) Appl. No.: 10/554,373

(22) PCT Filed: Apr. 28, 2004

(86) PCT No.: PCT/AU2004/000544

§ 371 (c)(1),
(2), (4) Date: Aug. 21, 2006

(87) PCT Pub. No.: WO2004/097295

PCT Pub. Date: Nov. 11, 2004

(65) Prior Publication Data

US 2006/0291198 A1 Dec. 28, 2006

(30) Foreign Application Priority Data

Apr. 29, 2003 (AU) ..... 2003902031

(51) Int. Cl.
*F21L 4/00* (2006.01)

(52) U.S. Cl. ..... 362/191; 362/202; 362/208

(58) Field of Classification Search ..... None
See application file for complete search history.

(56) References Cited

U.S. PATENT DOCUMENTS

| | | | | | |
|---|---|---|---|---|---|
| 1,454,530 | A | * | 5/1923 | Arnold | 362/191 |
| 2,361,414 | A | * | 10/1944 | Ramsey | 362/108 |
| 3,184,593 | A | | 5/1965 | Wiegeimann et al. | |
| 4,360,930 | A | * | 11/1982 | Blanchard | 362/105 |
| 5,448,458 | A | * | 9/1995 | Smyly, Jr. | 362/570 |
| 5,558,044 | A | | 9/1996 | Nasser, Jr. et al. | |
| 5,558,430 | A | * | 9/1996 | Booty, Jr. | 362/184 |

(Continued)

FOREIGN PATENT DOCUMENTS

DE 29607524 U1 7/1996

(Continued)

OTHER PUBLICATIONS

Office Action from People's Republic of China for Application No. 200480018559.1, filed Apr. 28, 2004, mailed May 9, 2008, 9 pages.

*Primary Examiner*—Bao Q Truong
(74) *Attorney, Agent, or Firm*—Gregory J. Adams

(57) ABSTRACT

A lighting device (30) having a housing (12) which includes a lamp means, a battery housing to receive at least one battery and a switch means to open and close a circuit between said lamp means and terminals of said at least one battery when located in said housing. Said lighting device includes a lanyard (110, 112) attached to said housing (12) characterised by said lanyard having a proximal end attached to said housing (12) and a distal end, whereby said distal end or a portion of said lanyard (110, 112) is adapted to be releasably attached to said housing (12).

27 Claims, 9 Drawing Sheets

U.S. PATENT DOCUMENTS 5,921,657 A * 7/1999 Case ..... 362/191

FOREIGN PATENT DOCUMENTS

EP 1291577 A10 3/2003

FR 2760817 A1 9/1998

GB 2243677 A 11/1991

WO 02/25166 A1 3/2002

* cited by examiner 12
94
92
70
86
54
44
30
32
42
66
57
51
36
40
76
34
23
55
25
38
74
28
18
26
70
37
A
A
60
68
16

12
10
14
24
61
23
20

LIGHTING DEVICE

FIELD OF THE INVENTION

The present invention relates to a lighting device, in particular to a lighting device having two modes of operation.

BACKGROUND OF THE INVENTION

The present invention seeks to provide a lighting device having two modes of operation so that it can operate as a hand held flashlight or in another mode, such as a hanging light source or a lamp on a table or flat surface.

SUMMARY OF THE INVENTION

The present invention provides a lighting device having a housing which includes a lamp means, a battery housing to receive at least one battery and a switch means to open and close a circuit between said lamp means and terminals of said at least one battery when located in said housing said lighting device including a lanyard attached to said housing characterised by said lanyard having a proximal end attached to said housing and a distal end, whereby said distal end or a portion of said lanyard is adapted to be releasably attached to said housing.

The lanyard can include a loop of cord.

The housing can include a member which will releasably attach said distal end.

The member can be a hook means.

The member can include an aperture means.

The distal end can include a hook means to engage said aperture means.

The housing can include an adjustable securing means to secure said distal end or a portion of said lanyard to said housing.

The adjustable clasp can provide a means to secure said distal end or a portion of said lanyard so as to vary the length of said lanyard between said clasp and said proximal end.

The adjustable securing means can be a clasp.

The adjustable securing means can include an over centre securing mechanism.

The adjustable securing means can clamp said lanyard to said housing or a portion of said adjustable securing means.

The lanyard can be comprised of a cable means which has its proximal end attached to said housing.

The adjustable securing means can include a cleat.

The lanyard can be made from a material which allows some deformation when compressed, so that said cleat can engage said lanyard and hold same from moving in one direction relative to said cleat.

Alternatively the cleat can have formations to receive therein mating formations formed in the surface of said lanyard.

The cleat can include a converging passage therethrough, so as to clamp said lanyard in said cleat, when said lanyard is pushed into said cleat.

The present invention also provides a portable battery powered lighting device with two modes of operation including a first mode for producing a beam and a second mode for producing an omnidirectional light source, said lighting device including a housing, said housing having opposite ends; and further including a removable end member, said end member including a light reflector whereby in said first mode said reflector is affixed to one end of said housing enclosing a light source to thereby produce a beam, and in said second mode, said end member is affixed to the other end of said housing whereby said end member acts as a stand, said housing and said end member being made of a polymeric material, said end member including a portion having a metal covering.

The housing can accommodate a battery means, and can further include a first closure means for closing a first end of said housing, second closure means for closing the other end of said housing, one of said first or second closure means having means for accommodating a light source, a circuit means for connecting said light source in a circuit including said battery means and a switch means.

The housing can be cylindrical.

The end member can include a front section joining to a rear frustoconical section. The frustoconical section can include a further section extending forwardly inside said frustoconical section. The frustoconical section can include an external surface which has said metal covering fitted thereto.

The switch means can be removable.

The present invention further provides a portable self contained lighting device of modular construction including a housing for accommodating a power source, said housing being open at both ends, closure means for closing each end of said housing, a lamp means accommodated by one of said closure means, said lamp means and said power source being connected in series via a circuit including a removable switch.

The present invention also provides a removable switch for a portable electric lighting device including a body having a base, a first conductive contact extending from said base and is connected with one pole of a switch mechanism on a front face of said body, said switch mechanism also connecting to a second conductive contact in the base of said housing whereby said first conductive contact is connected to said second conductive contact when said switch is closed.

The body can include wing elements extending therefrom.

The first conductive contact can includes a tongue of metal connected with said one pole of said switch mechanism.

The present invention further provides a flashlight having a battery housing and a lens region, said lens region including a lamp means and a body portion therearound, said body portion including two spaced apart grooves therearound and a decorative annulus between said grooves, said annulus including annular ridges thereon to sit in said grooves, to thereby hold said annulus in place on said body portion.

The body portion and said annulus can be generally frustoconical in shape.

The applicant does not concede that the prior art discussed in the specification forms part of the common general knowledge in the art at the priority date of this application.

BRIEF DESCRIPTION OF THE DRAWINGS

An embodiment or embodiments of the present invention will now be described, by way of example only, with reference to the accompanying drawings, in which.

DETAILED DESCRIPTION OF THE EMBODIMENT OR EMBODIMENTS

Figures 1, 2:
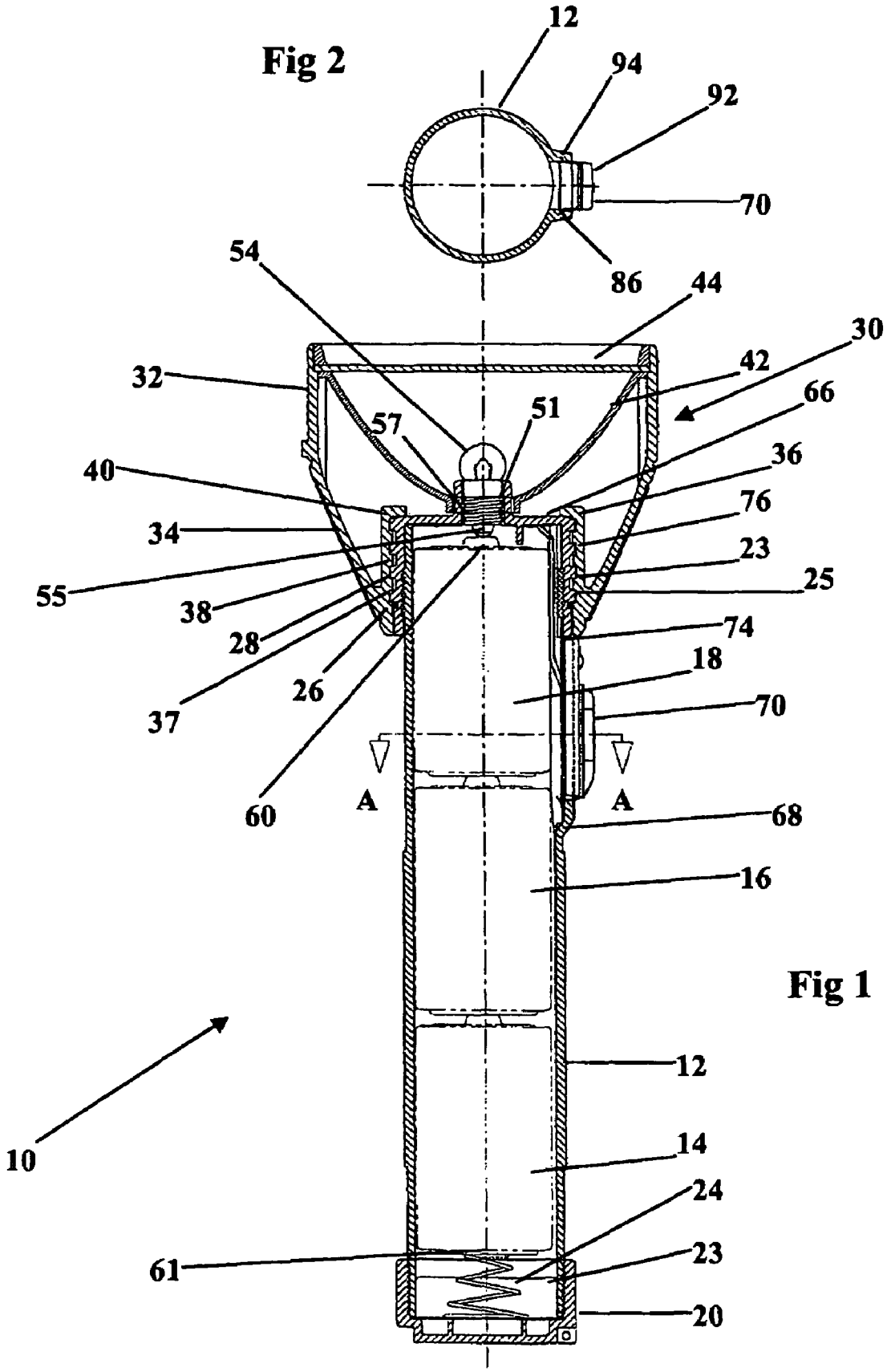
FIG. 1 shows a cross section of a first embodiment of the invention in elevation.
FIG. 2 shows a cross section of FIG. 1 along the line A-A.

Referring to FIG. 1, the lighting device 10 includes an open ended cylindrical tube 12 housing a number of dry cells or batteries 14, 16, 18 which are accommodated in the housing 12 between a bottom closure member 20 and top closure member 22. The bottom closure member 20 screws onto one end of the cylindrical housing 12 and a spring 24, held in the base of the closure member 20, biases the batteries 14, 16, 18 towards the top closure member 22. The spring 24 is, for example, a metal spiral spring.

The upper closure member 22 is cylindrical and has an internal thread 26 which is screwed onto an external thread at the top end of the cylindrical housing 12. Top closure member 22 also has a external surface with a thread 28 for mating of a reflector assembly 30 thereto.

The reflector assembly 30 includes a front cylindrical section 32 joined to a frustoconical rear section 34. A further cylindrical section 36 extends forwardly towards front cylindrical section 32 inside the frustoconical section 34. Section 36 includes an internal screw thread 38 for mating with the external screw thread 28 on the top end closure 22. An O-ring 37 acts as a friction washer between the screw threaded internal surface 38 of the further cylindrical section 36 and the screw threaded section 28 of the top end closure 22 to prevent unwanted relative rotation. The threaded section 36 has at the forwardly facing end thereof a flange 40 or annular ring acting as a stop for the threaded section 36. The cylindrical front section 32 provides support for a reflector 42 and a transparent lens or cover plate 44. The reflector 42 can be made of a polymeric or plastics material covered with a highly reflective coating.

The frusto-conical section 34 has two similar grooves 7 and 9 near the beginning and end of the frustoconical portion which is covered with a frustoconical annulus 46 to provide both a decorative feature and a reinforcing for the reflector assembly 30. The annulus 46 has flanges at the rims thereof which make a firm pressing fit with slots or grooves and in the frusto-conical section 34. The frustoconical annulus, being of metal adds weight to the reflector assembly 30, thus assisting the reflector assembly to serve the function of a base as will be described below in relation to FIG. 4.

The reflector assembly 30 can be provided with a serrated or jagged ring 31 for gripping, frictional contact or similar purposes.

The cylindrical upper end closure member 22 is closed at one end by a discoid covering 50 in the centre of which is an upstanding internally threaded socket 52 for accommodating light bulb 54 of the Edison screw type. The light bulb 54 is screwed into the socket 52 until it engages with the pole 60 of the battery 18. The interior or base of the socket 52 is provided with a conductive contact 51. Batteries 18, 16 and 14 are connected in series and biased together by the spring 24, which can be compressed by tightening the bottom closure member 20 onto the housing 12 to provide the necessary contact. A circuit comprising the batteries 14, 16, 18, light bulb and interior circuit components 66, 68 are connected through a switch 70. Interior circuit components 66, 68 can be wire or metal strip elements or such as within the knowledge of the person skilled in the art. These components 66, 68 can be secured to the interior of the housing 12 and connect respectively conductive contact 51 of socket 52 to switch 70 and switch 70 to pole 61 of battery 14 via metal spring 24. The switch 70 can be, for example, of a sliding, a press button, or a rotary type of operation.

The switch 70 is designed to be replaceable and includes a switch body portion 72 from which extends a metal tongue 74 at the end of which is a bent prong 76. The tongue 74 and the prong 76 act as a spring when the switch 70 is slid into the accommodating bay 80 formed in the body of the cylindrical housing 12. The switch 70 has wings 82 extending outwardly from the central portion 78 of the switch body portion 72. These wings 82 interact with the slots 86 cut in the bay 80 of the housing 12 (see FIG. 3). The switch 70 has an electrical contact (not shown) on the underside of the body portion 72 which contacts the fixed contact 90 at the closed end of the bay 80. In this way, the switch 70 can be removed and replaced as required as the switch element 88 wears with time or as the contacts become corroded or lose their resilience. The tongue 74 and prong 76 are resiliently biased by the positioning of the switch 70 in the housing 12 to the conductive contact on the interior surface of the discoid covering 50 of the end closure member 22 forming part of circuit component 66. The socket 52 for the light bulb 54 is, as stated, also provided on its interior threaded surface or the base thereof with a conductive contact 51 enabling current to flow through the light bulb 54 in the usual manner of an Edison fitting from the knob 55 to the exterior screw threaded shell 57.

Figure 3:
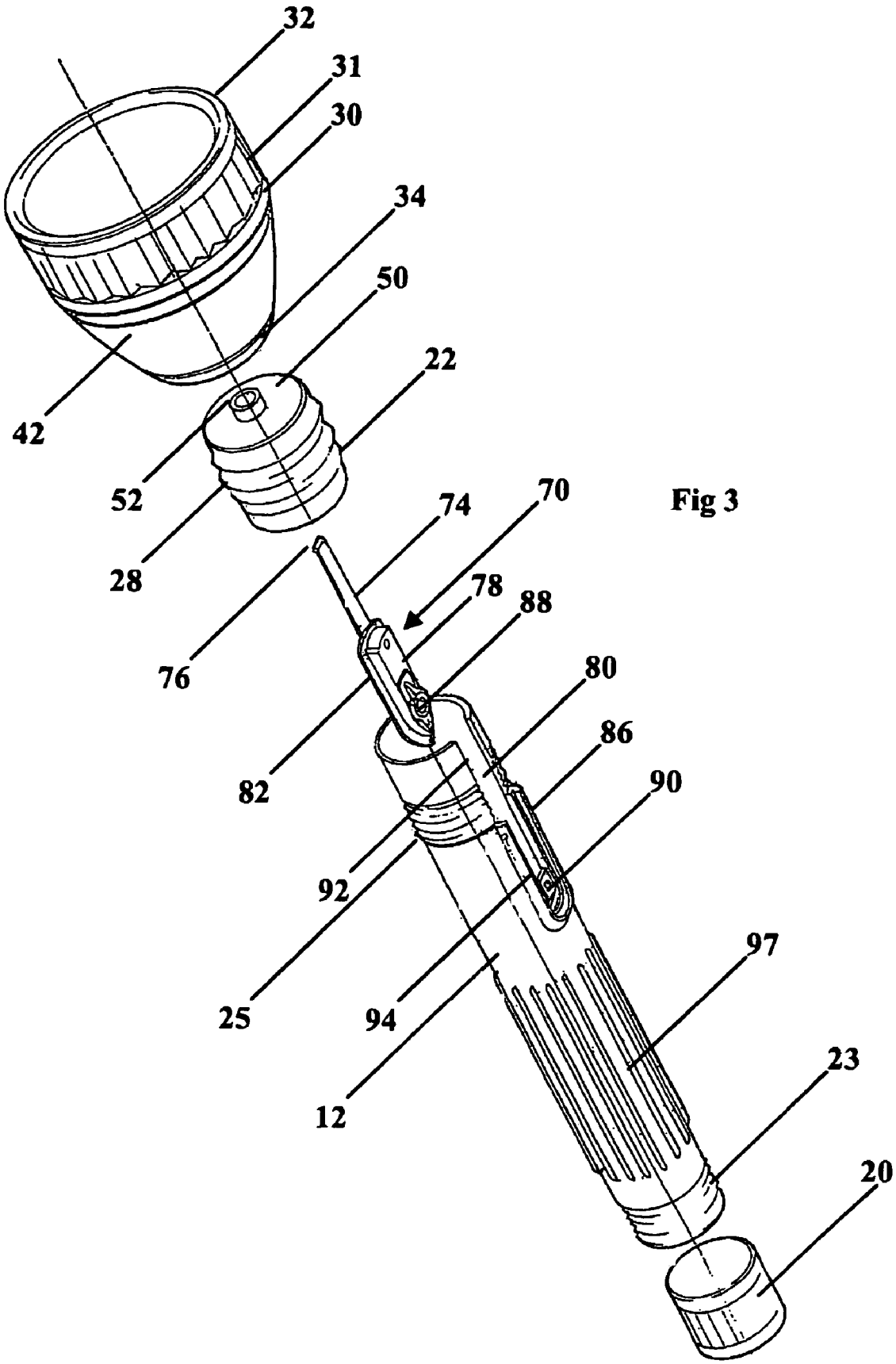
FIG. 3 shows an exploded view of the embodiment of FIG. 1.

As shown in the exploded view of FIG. 3, the housing 12 for the batteries 14, 16, 18 is essentially an open ended cylindrical tube with screw threaded ends 23, 25 to accommodate the closure members 20 and 22 on the threaded portions 23 and 25 respectively. The housing 12 has a longitudinal slot 92 in the housing 12 along part of its longitudinal axis. The slot 92 is closed below the threaded section 25 to form bay 80, which is bordered by a docking flange 94. The flange 94 is of a U-shape having an internal slot 86 acting as rails for the wings 82 of the switch 70. The switch central portion 78 is shaped in a complementary manner to the shape of the bay 80 so that when the wings 82 are accommodated in and slid along the slot 86, the switch 70 is held in a fixed relation to the contact 90 as are the tongue 74 and prong 76 to the top closure member 22. The slot 86 in the body of the housing 12 provides a reliable and sure fit to accommodate the switch 70 and align it with the contact 90.

The screwing on of the closure 22 pushes and secures the switch 70 into position. The closure 22 ensures that the contacts engage each other.

The exterior of the housing 12 can be provided with ribs or ridges 97 to act as a grip.

Figure 4:
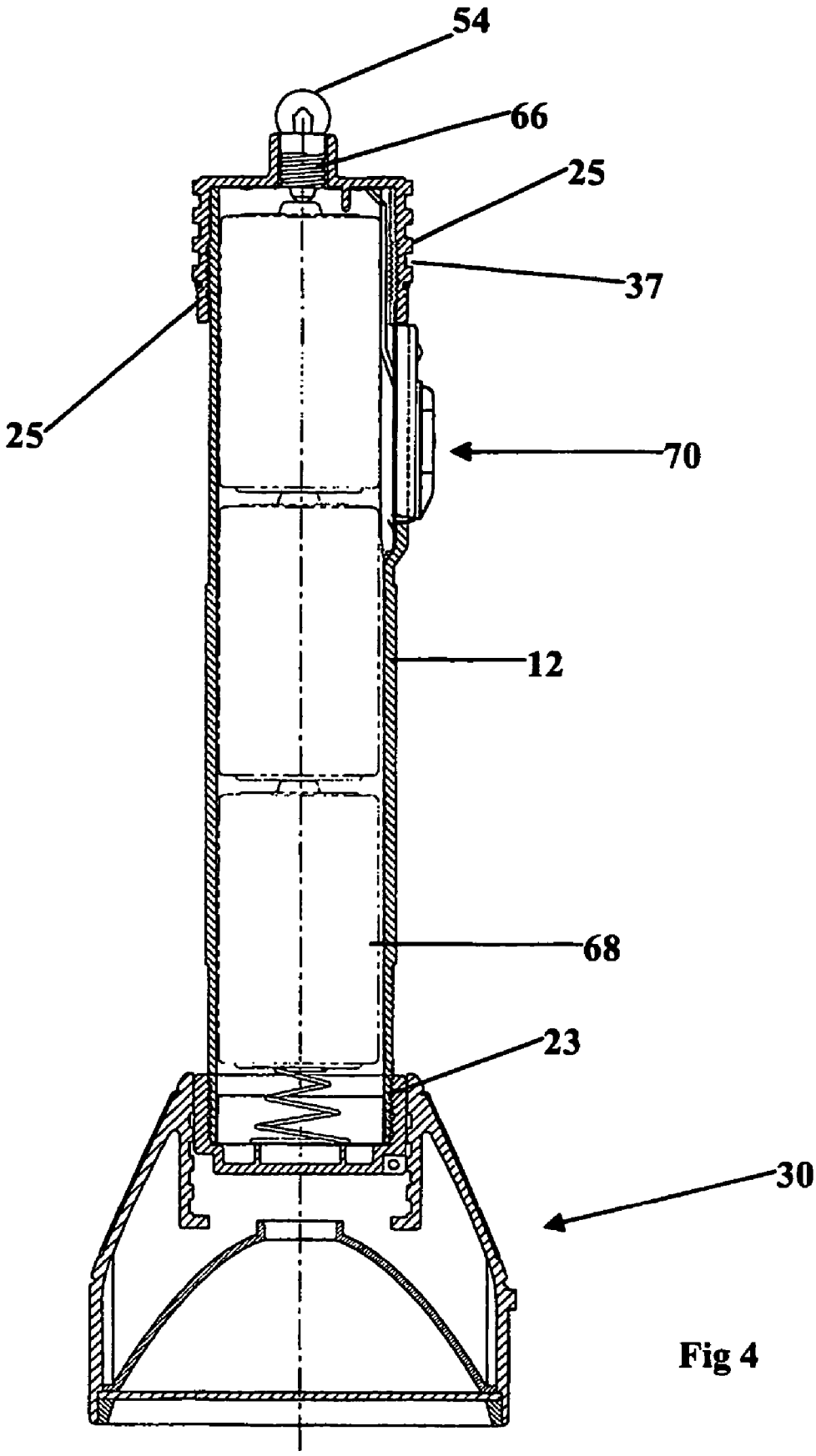
FIG. 4 shows an alternative mode of operation of the embodiment of FIG. 1.

FIG. 1 shows the operation of the lighting device as a flashlight whereby the reflector 42 provides a beam of light in the usual manner. A second mode of operation of the lighting device according to the invention is possible as shown in FIG. 4. By unscrewing the reflector assembly 30 from the top closure member 22 the light source is exposed in its socket. By having the exterior diameter of the end closure member 20 matching the interior diameter of the forward facing section 38 of light bulb reflector assembly 30, the bottom end closure member can be fitted therein. Such fitting can include a press fit or a screw threaded arrangement or such as within the knowledge of a person skilled in the art. The cylindrical and frustoconical sections 34 and 32 can now form a stand for the cylindrical housing 12 forming a candle-like light source providing a substantially omnidirectional illumination.

Figure 5:
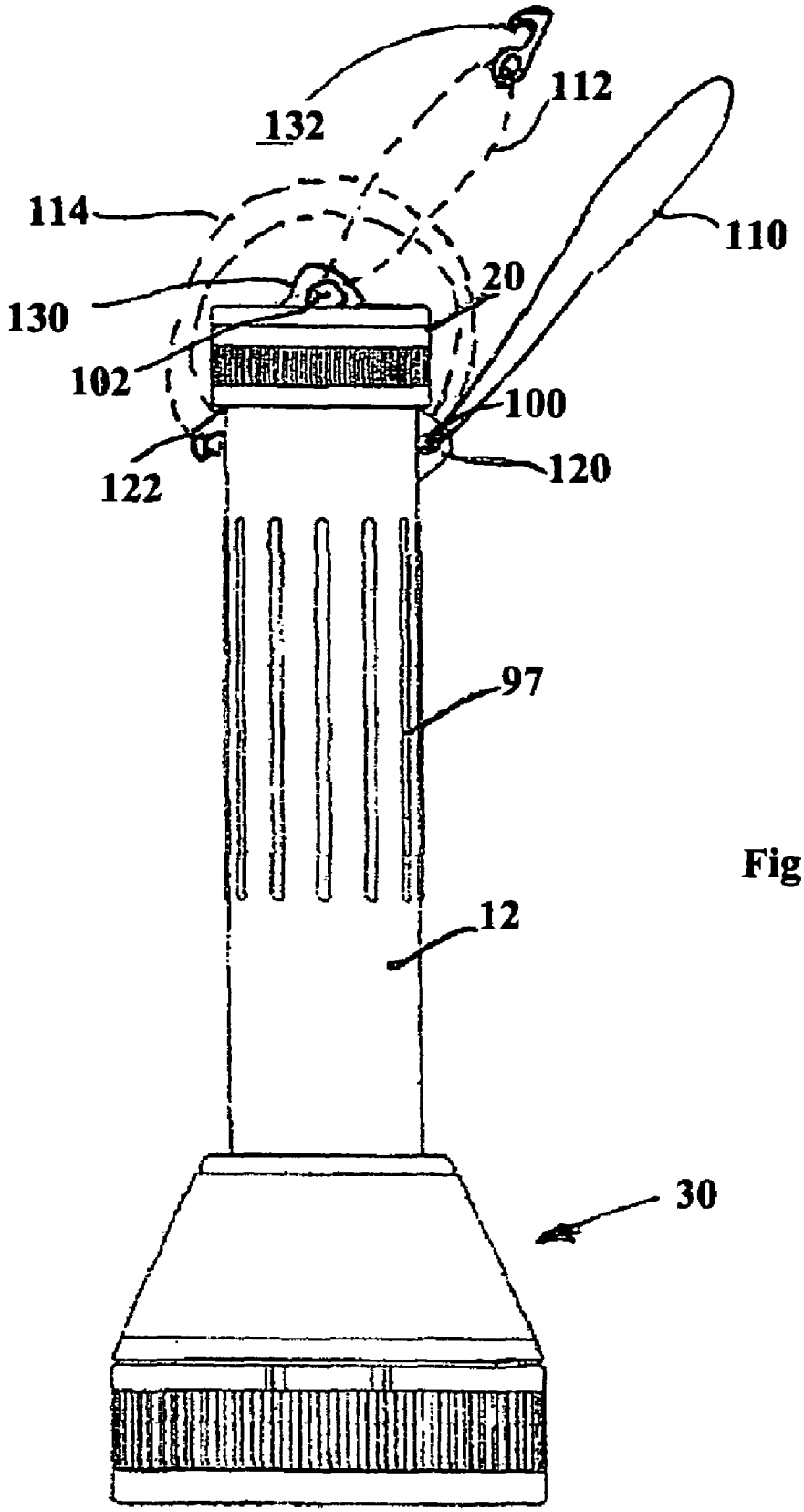
FIG. 5 shows an external view of the embodiment of FIG. 1.

Referring to FIG. 5, the lighting device can include on the cylindrical housing 12 at that end, an eyelet 120 or alternatively on the bottom end closure member 20 a central eyelet 130 to receive a lanyard or loop 110 or 112 respectively. That is, a rope or cord, for example, is looped through the aperture 100 in the eyelet 120 or aperture 102 in the eyelet 130 so that the loop 110 or 112 respectively enables the lighting device 10 to be carried or suspended therefrom.

Further, when the eyelet 120 is provided on the housing 12, then a hook 122 can be provided on a diametrically opposite location, so that the distal end of loop 110 can be releasably caught onto a hook 122 as shown in dotted line 114. This will allow the lighting device 10 to be suspended by the now decreased diameter of loop in a generally plumb fashion. If the lanyard 110 is not caught onto hook 122, the lighting device will hang in a non-plumb fashion. Alternatively the loop 110 or 112 can have a hook 132 attached directly to the loop or indirectly, whereby the hook 132 is on an extra length of rope or cord.

The hook 132 if on the lanyard 110 which can then be attached to the hook 122. Alternatively the eyelet 130 can be provided with a suitably sized aperture whereby the hook 132 on lanyard 112 can be connected to the eyelet 130 in addition to the other end of the lanyard 112.

By this means, the lighting device can be securely suspended in a substantially vertically downward orientation.

Figure 7:
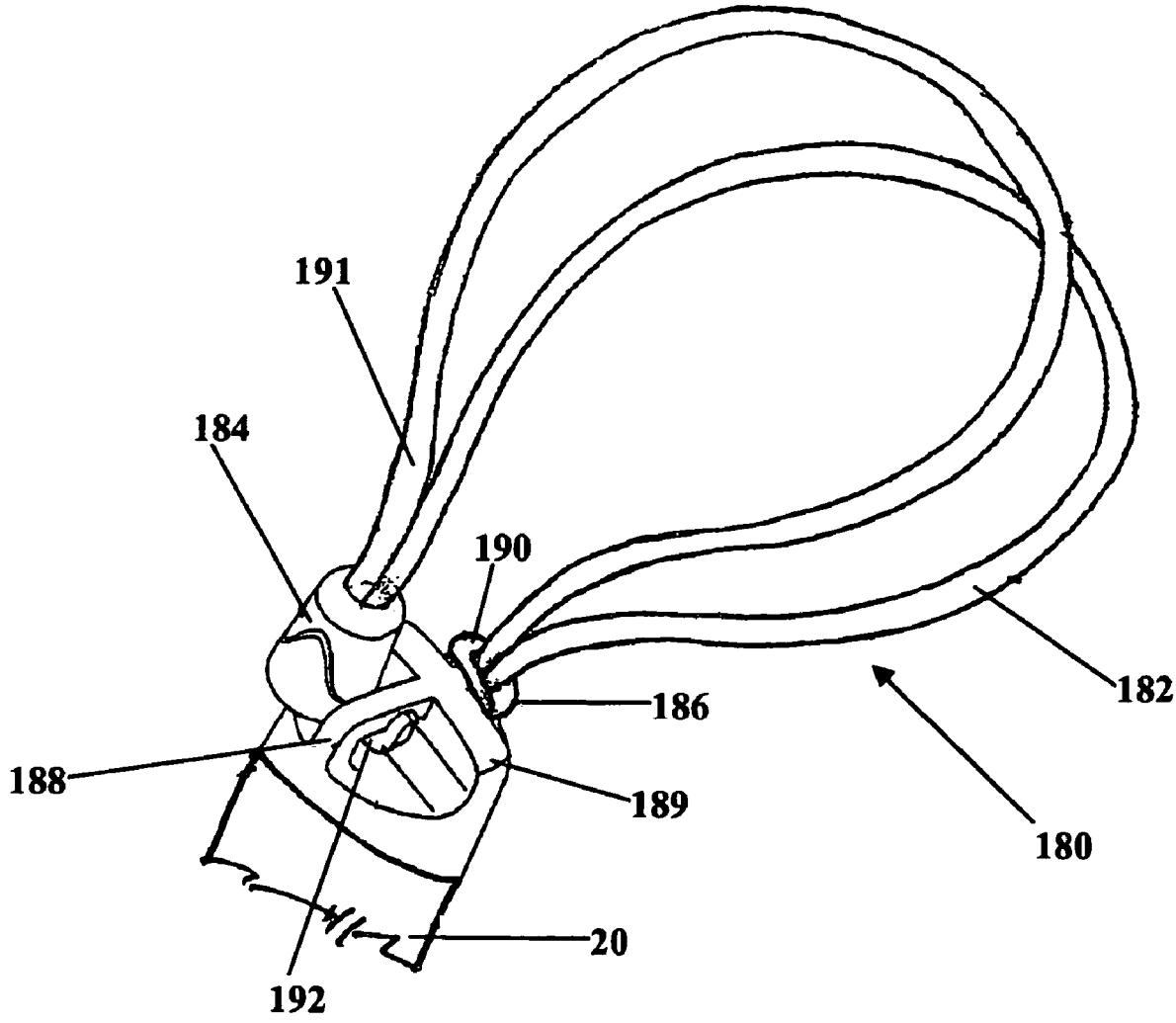
FIG. 7 shows an alternative form of lanyard.

An alternative arrangement for a lanyard attachment is illustrated in FIG. 7, which shows the end or base 21 of a flashlight, which can be an integrally formed end or a screw-on or bayonet fitted end or bottom closure. The base 21 is provided with two apertures at diametrically opposed locations. The two apertures are formed in side arms 186 and 188 which extend from a centrally located diametrically extending shoulder 189 to create a cruciform appearance. The two apertures in the side arms 186, 188 are used to support the lanyard 180.

The lanyard 180 comprises a loop formed by knotting a cord 182, the knot being hidden from view inside conical ferrule 184. The end 190 of the lanyard 180 is held on one side arm 186 by being threaded through the aperture in the arm 186, and passing the lanyard through itself so that the lanyard is captured onto the arm 186. A hook 192, attached to the ferrule 184, attaches the other end 191 onto the other side arm 188 whereby the end 20 of the flashlight can be suspended as described above.

Figure 8:
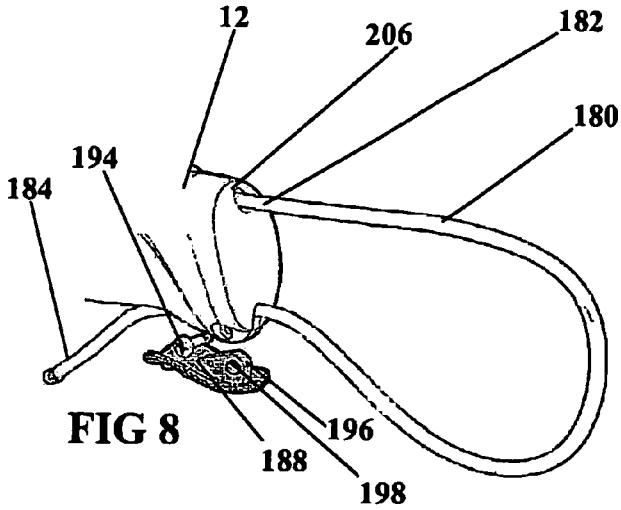
FIG. 8 illustrates another embodiment showing an exploded view of a single strand lanyard having a free end for securing to a flashlight housing.
Figure 9:
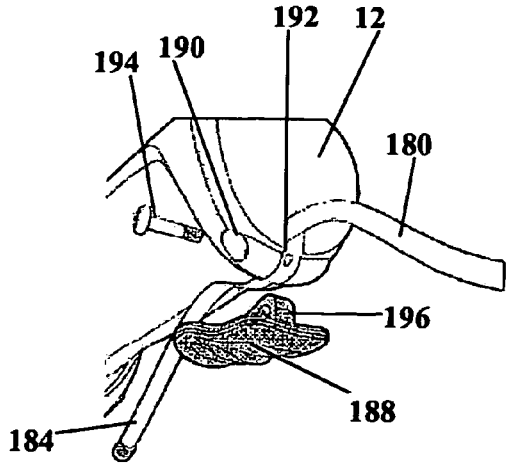
FIG. 9 illustrates another exploded rear view of the flashlight of FIG. 8, showing the over centre clamping mechanism.

If desired, a single thread or end of the lanyard 180 can be threaded through the aperture in arm 186, whereby both ends of the lanyard 180 can be then threaded through an aperture in the ferrule 184 (with hook 192), and the two ends of the lanyard 180 tied in a figure-8 knot or similar, with the ferrule 184 then being pushed along to cover the knot made.

Figure 6:
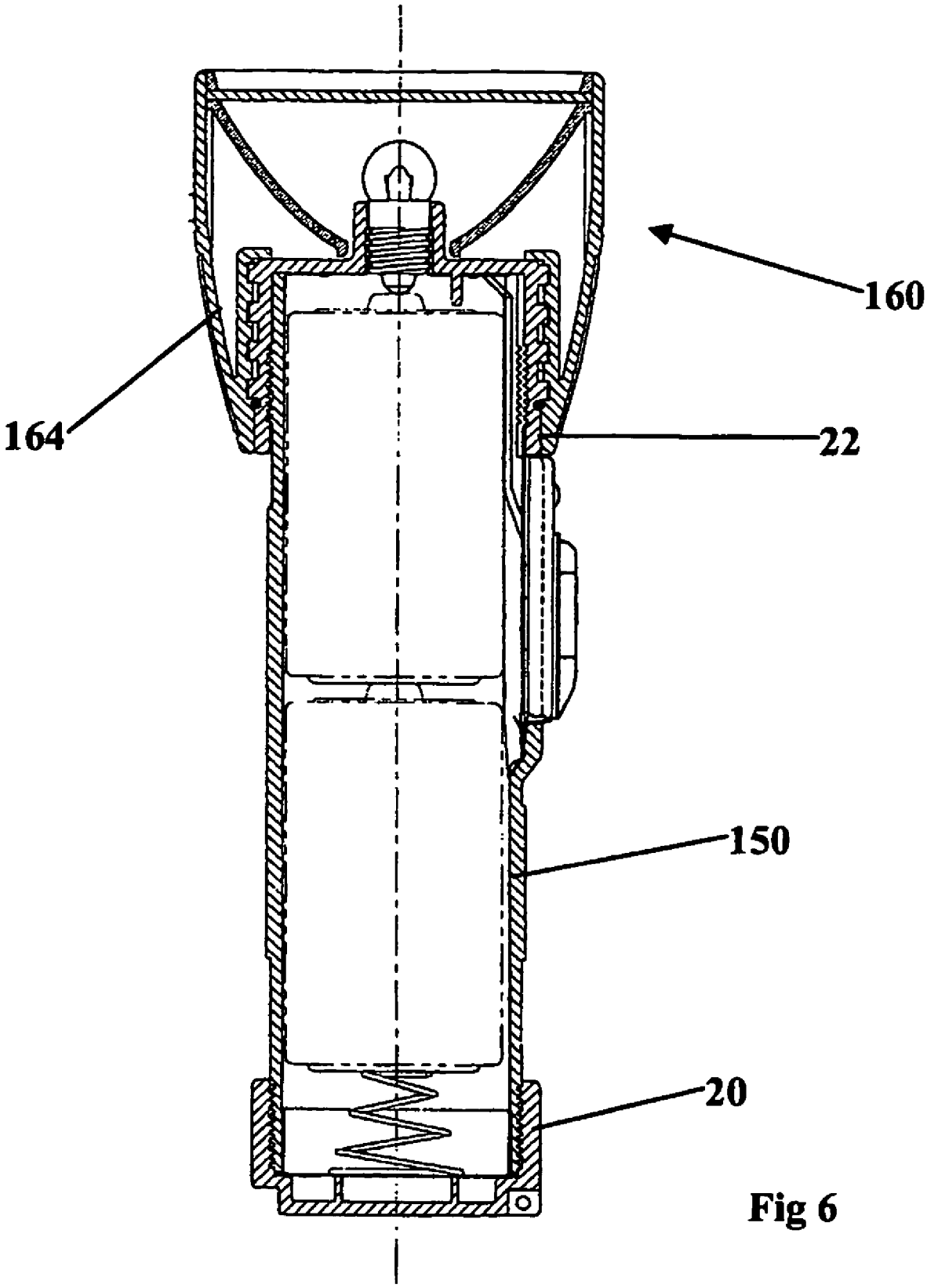
FIG. 6 shows a second embodiment of the invention.

A second embodiment of the invention is shown in FIG. 6 and includes a housing 150 to accommodate two batteries, for example, C or D sized batteries. The embodiment of FIG. 1, as shown accommodates three batteries. The end covering 160 is also of a slightly different shape to that shown for the embodiment of FIG. 1, having a shallower frustro-conical section 164 with all the other elements of the lighting device being substantially as described with respect to FIGS. 1 to 5.

Illustrated in FIGS. 8 to 12, and FIG. 15 is another lanyard arrangement where the lanyard 180 is a stainless steel cable with its proximal end 182 secured and a distal end 184 being free of the flashlight housing 12. The flashlight housing 12 includes over centre clamping mechanism 186, which is operated by a lever 188 to clamp a portion of the lanyard 180, or the distal end 184 of the lanyard 180 to the flashlight housing 12, or within the clamping mechanism 186 itself.

The lever 188 is pivotally connected to the housing 12 by means of a yoke 190 formed on either side of a slot 192 formed in the rear end of the housing 12. The lever 188 is mounted in the yoke 190 by means of a pin in the form of a bolt 194.

Figure 11:
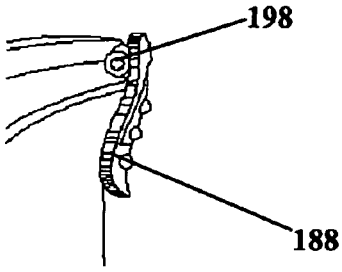
FIG. 11 illustrates a partial detail showing the over centre clamping mechanism.
Figure 12:
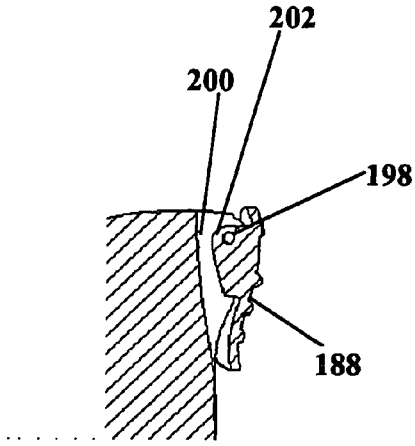
FIG. 12 illustrates a cross section through the over centre clamping mechanism of FIG. 11.

The lever 188 has a clamping tongue 196 formed integrally with the lever 188. The tongue 196 is shown in the detailed cross section of FIG. 12. The tongue 196 has a pivot aperture 198 through it, which is located in the tongue so that in the position relative to the housing 12 as illustrated in FIG. 11 and 12, then the gap 200, between the base of the slot 192 and the nearest portion 202 of the tongue 196, is narrower than the diameter of the lanyard 180.

Whereas, when the lever 188 is rotated away from the housing 12, the gap 200 will increase thereby releasing the cable 180.

The width of the slot 192 is marginally larger than the diameter of the lanyard 180. Further the width of the tongue 196 is sized to move freely in the slot 192, but is wide enough to provide sufficient contact width over and with the lanyard 180.

Figure 10:
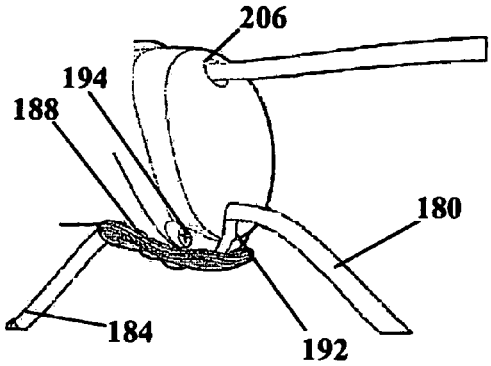
FIG. 10 illustrates the over centre clamping mechanism of the flashlight of FIGS. 8 and 9 in an assembled condition, with the over centre clamping mechanism, securing the free end of the lanyard to the flashlight housing.
Figure 15:
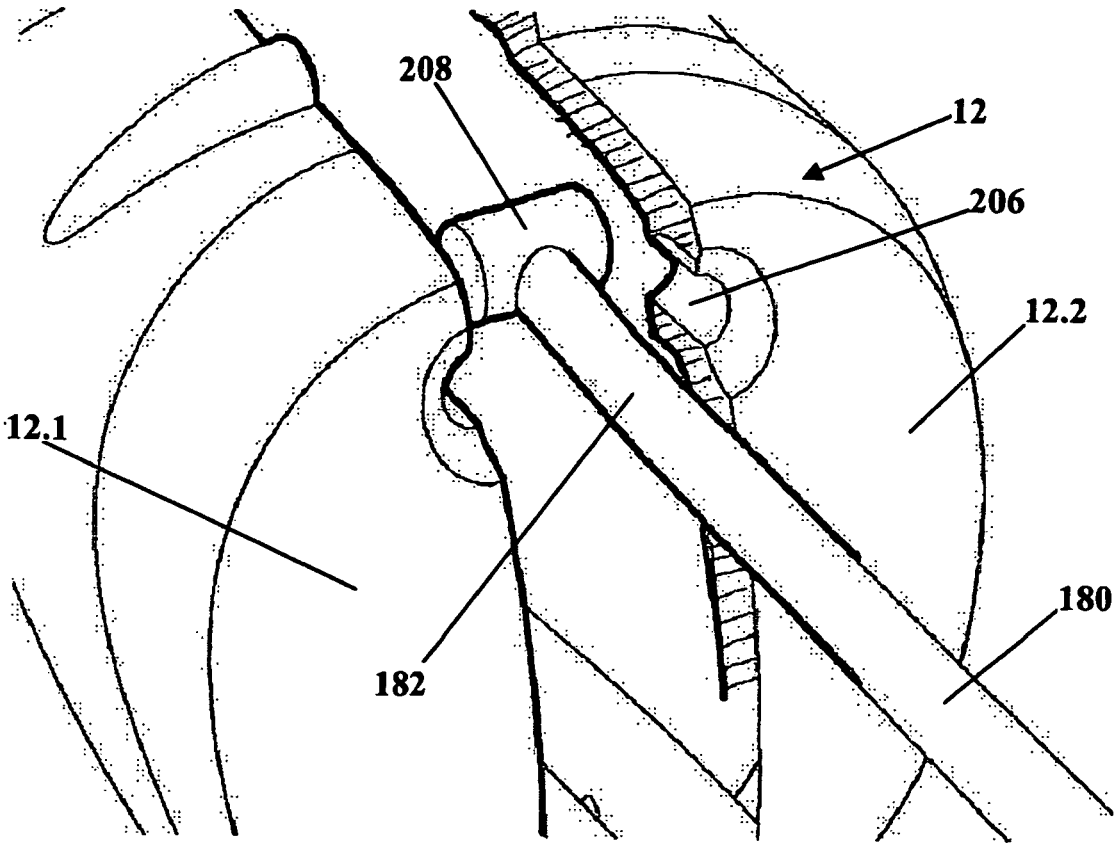
FIG. 15 illustrates how the proximal end of the lanyard of FIGS. 8 to 10 is captured in the flashlight housing.

As is illustrated in FIGS. 8, 10 and 15, the proximal end 182 of the cable 180 passes out of the rear end of the housing 12 through an aperture 206. However, as illustrated in FIG. 15, the proximal end 182 terminates with a crimped stop 208, which allows the proximal end 182 to be captured between opposite halves 12.1 and 12.2 of the housing 12.

In this embodiment of FIGS. 8 to 12 and 15, the lanyard 180 is a steel or stainless steel cable, which is substantially incompressible when the clamping mechanism 186 engages it so as to produce a friction force therewith to prevent the lanyard moving relative to the clamping mechanism.

The over centre clamping mechanism 186 provides an adjustable securing means to secure the distal end 184 or a portion of the lanyard 180 to the housing 12. By this mechanism 186, a user can adjust the tension on the lanyard, to thereby secure the end of the flashlight to a pole, or an overhead wire or cord.

Figure 13:
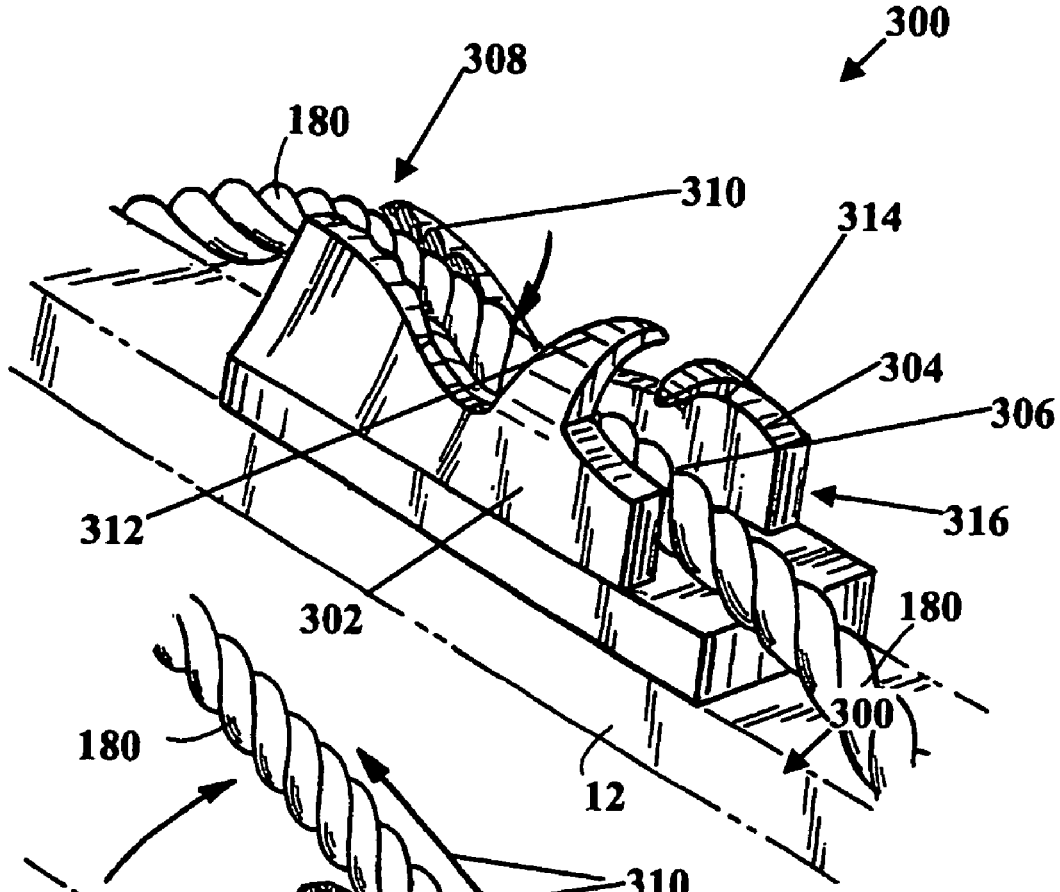
FIG. 13 illustrates perspective view of a cleat with the free end of a single strand lanyard being secured to the flashlight housing and immovable therein.
Figure 14:
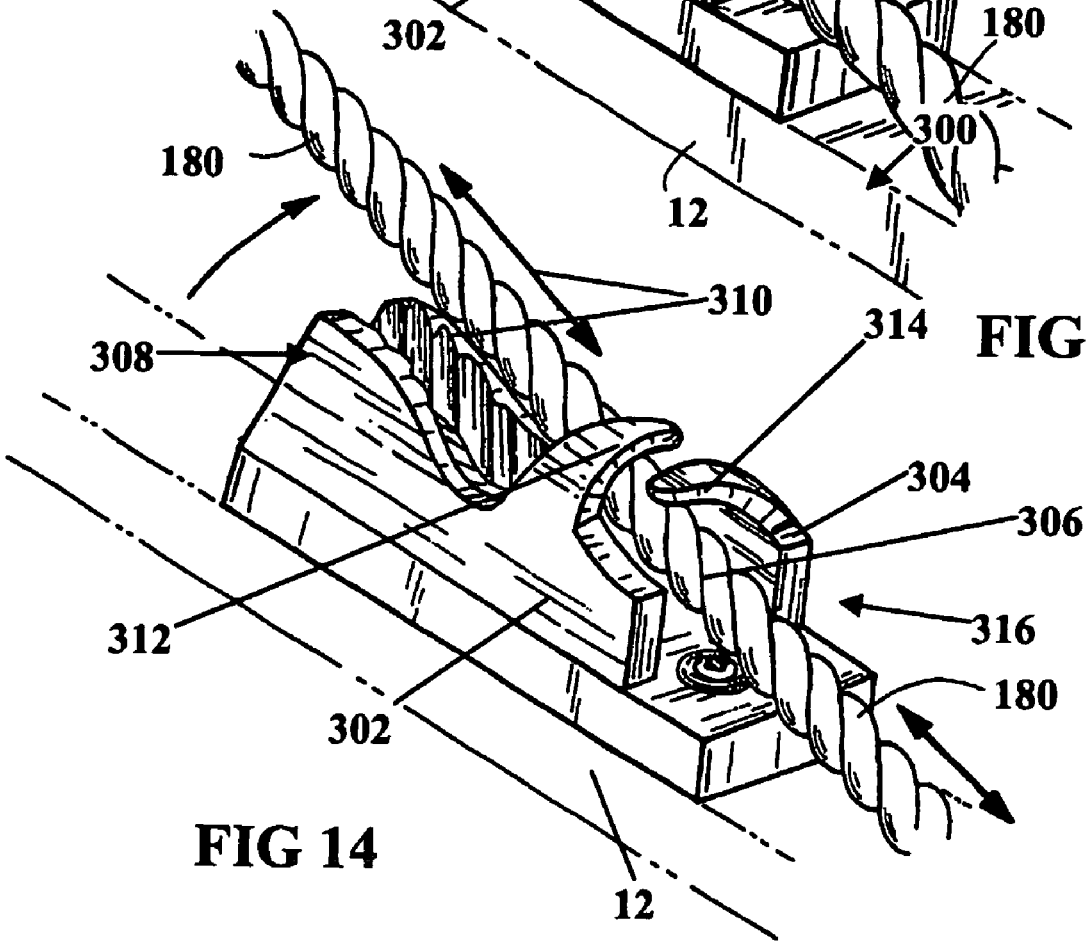
FIG. 14 illustrates a perspective view which is similar to that of FIG. 13, showing the position of the lanyard where it is free to move backward or forward relative to the cleat.

Illustrated in FIGS. 13 and 14 is a cleat 300, which is either integrally formed on the housing 12, or attached thereto by a rivet, screw, or sonic welded connection.

The cleat 300 includes two side members 302 and 304 which together form a passage 306 therebetween. The passage 306 at the end 308 of the cleat 300, has a converging cross section in the direction towards the housing 12 or the base of the passage 306. The side walls 302 and 304 in the region of end 308 also has grooved formations 310 which receive the complementary shaped twists of the cable 180. The formation 310 and the converging cross section of the passage 306 at end 308, will clamp the lanyard 180 in the cleat 300, when the lanyard is pushed towards the housing 12 or the base of the passage 306, while in the cleat 300.

The cleat 300 also includes a left wing 312 and a right wing 314 which are flexible and which extend from the side member 302 and 304, towards the opposite side member at the end 316 of the cleat 300. The end 316 is at the opposite end of the cleat 300 to the end 308.

Illustrated in FIG. 14 the lanyard 180 is shown out of engagement with the end 308 of the cleat 300, but still retained in the end 316, by means of the wings 312 and 314. This allows the lanyard 180 to be tensioned or loosened and then secured back into the cleat 300 as in FIG. 13.

In the embodiment of FIGS. 13 and 14, the lanyard 180 is made from a twisted cord material or a moulded filament, with a moulded twist formation on its outside surface.

The above described adjustable securing mechanisms in the form of mechanism 186, or the cleat 300, will allow a user to vary the length of the lanyard 180 between securing mechanism and the proximal end of the lanyard.

While the cleat of FIGS. 13 and 14 includes groove formation 310 so as to receive similarly shape twist formations on the lanyard 180, whereby relatively little deformation of the lanyard 180 need occur. If desired a cleat arrangement can be used which causes some deformation of the lanyard 180 when the lanyard is compressed into the cleat. Such a cleat can engage the lanyard, by means of barbs on the cleat moving into the lanyard so as to compress and hold the lanyard and preventing the lanyard from being withdrawn from the cleat. Such a cleat will also allow the lanyard to be pulled tight so to place the portion of the lanyard between the cleat and the proximal end of the lanyard in tension. This can be handy to provide additional friction, for such times when the flashlight is to be attached to and around a pole. The additional tension and thus friction can help prevent the flashlight sliding down such a pole.

It will be understood that the invention disclosed and defined herein extends to all alternative combinations of two or more of the individual features mentioned or evident from the text. All of these different combinations constitute various alternative aspects of the invention.

The foregoing describes embodiments of the present invention and modifications, obvious to those skilled in the art can be made thereto, without departing from the scope of the present invention.

The invention claimed is:

1. A lighting device comprising:

a housing which includes a lamp, a proximal attachment mechanism, and a distal attachment mechanism;

a battery housing to receive at least one battery; and a switch to open and close a circuit between said lamp and terminals of said at least one battery when located in said housing;

a lanyard attached to said housing, said lanyard having a proximal end attached to said proximal attachment mechanism and a distal end releasably attached to said distal attachment mechanism, wherein said proximal end remains attached to said proximal attachment mechanism when detaching said releasably attached distal end from said distal attachment mechanism.

2. The lighting device of claim 1, wherein said lanyard includes a loop of cord.

3. The lighting device of claim 1, wherein said proximal attachment mechanism is an eyelet.

4. The lighting device of claim 1, wherein said distal attachment mechanism includes an aperture.

5. The lighting device of claim 4, wherein said distal end includes a hook to engage said aperture.

6. The lighting device of claim 1, wherein said lanyard is comprised of a cable which has its proximal end attached to said housing.

7. The lighting device of claim 1, wherein said lanyard is attached to said housing at one end thereof.

8. The lighting device of claim 7, wherein said distal end of said lanyard is attached to said housing at or near said end.

9. The lighting device of claim 1, wherein the length of the lanyard between its proximal end and the attachment point is adjustable.

10. The lighting device of claim 1, wherein the lanyard has a substantially round cross section.

11. The lighting device of claim 1, wherein said distal attachment mechanism is a clamping mechanism.

12. The lighting device of claim 11, wherein the clamping mechanism includes a lever pivotally connected to the housing on either side of a slot formed in or on the housing.

13. The lighting device of claim 12, wherein the lever is rotated away from the housing to release said distal end of said lanyard and rotated towards said housing to attach said distal end to said lanyard.

14. A lighting device comprising:

a housing which includes a lamp and an adjustable securing apparatus;

a battery housing to receive at least one battery; and a switch to open and close a circuit between said lamp and terminals of said at least one battery when located in said housing; and a lanyard attached to said housing, said lanyard having a proximal end attached to said housing and a distal end releasably attached to said housing by said adjustable securing apparatus, wherein said adjustable securing apparatus alternately holds said distal end at one of a plurality of locations on said lanyard, wherein each of the locations corresponds to a different length of said lanyard between said adjustable securing apparatus and said proximal end.

15. The lighting device of claim 14, wherein said adjustable securing apparatus comprises a clasp.

16. The lighting device of claim 15, wherein said adjustable clasp secures said distal end or a portion of said lanyard so as to vary the length of said lanyard between said clasp and said proximal end.

17. The lighting device of claim 14, wherein said adjustable securing apparatus includes an over centre securing mechanism.

18. The lighting device of claim 14, wherein said adjustable securing apparatus clamps said lanyard to said housing or a portion of said adjustable securing apparatus.

19. The lighting device of claim 14, wherein said adjustable securing apparatus includes a cleat, and said lanyard is made from a material which allows some deformation when compressed so that said cleat can engage said lanyard and hold same from moving in one direction relative to said cleat.

20. The lighting device of claim 18, wherein said housing includes a clamping recess adapted to receive said distal end of the lanyard, and said over centre clamping mechanism includes a clamping projection adapted to fit within said clamping recess to clamp said lanyard therein,

21. The lighting device of claim 14, wherein said adjustable securing apparatus is located on said housing so that, when said lighting device is suspended from said lanyard, light emitted from said lighting device is emitted in a substantially downward direction.

22. The lighting device of claim 21, wherein said light is emitted in a substantially vertical direction.

23. A lighting device comprising:

a housing including first and second different lanyard connectors; wherein the first and second different lanyard connectors are located at an end of the housing;

a lamp;

a battery housing to receive at least one battery;

a switch to open and close a circuit between said lamp and terminals of said at least one battery when located in said housing;

a lanyard attached to said housing, said lanyard having:

a first attachment mechanism affixed to a proximal end of the lanyard and attached to said first lanyard connector of said housing, and a second attachment mechanism affixed to a distal end of the lanyard and, releasably attached to the second lanyard connector of said housing, wherein said first attachment mechanism remains attached to said first lanyard connector of said housing when detaching said second attachment mechanism from said second lanyard connector of said housing.

24. The lighting device of claim 23, the housing further including an aperture, wherein said distal end attaches to said housing independent of said proximal end by said aperture, said aperture of said housing includes an arm, and said lanyard is formed of a loop of flexible material, said proximal end of said lanyard being attached to said arm by looping said lanyard through itself around said arm.

25. The lighting device of claim 24, wherein said aim farms part of an anchoring aperture through which a first portion of said loop is passed, said first portion of the loop being looped over said remainder of said lanyard and pulled back through said anchoring aperture to capture said lanyard in said anchoring aperture.

26. The lighting device of claim 24, wherein said distal end of said lanyard includes an attachment member to form a second attachment to said lighting device housing.

27. The lighting device of claim 24, wherein said lighting device housing includes a second anchoring aperture to cooperate with said attachment member.

* * * * *